US011204158B2

(12) United States Patent
Okamura et al.

(10) Patent No.: US 11,204,158 B2
(45) Date of Patent: Dec. 21, 2021

(54) LIGHTING UNIT

(71) Applicant: Yazaki Corporation, Tokyo (JP)

(72) Inventors: Sho Okamura, Shizuoka (JP); Yasuo Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/070,001

(22) Filed: Oct. 14, 2020

(65) Prior Publication Data

US 2021/0116113 A1 Apr. 22, 2021

(30) Foreign Application Priority Data

Oct. 16, 2019 (JP) ..... JP2019-189226

(51) Int. Cl.

| | |
|---|---|
| ***F21V 23/00*** | (2015.01) |
| ***F21V 15/01*** | (2006.01) |
| ***F21V 23/06*** | (2006.01) |
| ***F21Y 115/10*** | (2016.01) |

(52) U.S. Cl.

CPC ..... *F21V 23/001* (2013.01); *F21V 15/01* (2013.01); *F21V 23/06* (2013.01); *F21Y 2115/10* (2016.08)

(58) Field of Classification Search

CPC ..... F21V 23/001; F21V 15/01; F21V 23/06; F21V 19/0035; F21V 19/004; H01R 12/728; H01R 12/72; F21Y 2115/10; H05K 5/0026; H05K 5/0247; H05K 7/1417

See application file for complete search history.

(56) References Cited

U.S. PATENT DOCUMENTS

| | | | | |
|---|---|---|---|---|
| 10,859,234 | B2 * | 12/2020 | Suzuki | B60Q 3/51 |
| 2015/0345753 | A1 * | 12/2015 | Mochizuki | F21V 17/005 362/375 |
| 2018/0352671 | A1 * | 12/2018 | Takasaki | H05K 5/03 |

FOREIGN PATENT DOCUMENTS

| | | | | |
|---|---|---|---|---|
| JP | 2007207594 | * | 8/2007 | F21V 23/00 |
| JP | 2014-157689 | A | 8/2014 | |

OTHER PUBLICATIONS

English Translation of Japan 2007207594—Aug. 16, 2007, Hirotoku Tsukamoto (Year: 2007).*

* cited by examiner

*Primary Examiner* — Peggy A Neils
(74) *Attorney, Agent, or Firm* — Sughrue Mion, PLLC

(57) ABSTRACT

A lighting unit includes a housing, a bus bar and a circuit substrate. In a state where the bus bar is installed in the housing, a base part and a first spring part of the bus bar are held by the housing in a first direction, and the bus bar is positioned with respect to the housing in the first direction. In a state where the circuit substrate is installed to the bus bar installed in the housing, a bus bar contact part of the circuit substrate contacts a substrate contact part provided to a second spring part of the bus bar such that the circuit substrate is held by the base part and the second spring part in the first direction, and the circuit substrate is positioned with respect to the bus bar in the first direction.

6 Claims, 12 Drawing Sheets

LIGHTING UNIT

CROSS-REFERENCE TO RELATED APPLICATION

The present application is based on, and claims priority from Japanese Patent Application No. 2019-189226, filed on Oct. 16, 2019, the entire contents of which are incorporated herein by reference.

TECHNICAL FIELD

The disclosure relates to a lighting unit.

BACKGROUND

Conventionally, there has been proposed a lighting unit including a housing, a bus bar, and a circuit substrate (see JP 2014-157689). The bus bar is received in the housing. The circuit substrate is received in the housing and is provided with a light source. The bus bar is electrically connected to the circuit substrate.

SUMMARY

In the lighting unit, it is important to prevent an occurrence of malfunction of the circuit substrate due to breakage of the circuit substrate and to prevent a deterioration of contact reliability at an electrical connection portion between the bus bar and the circuit substrate, even when a load is applied to the circuit substrate due to an external force applied to the lighting unit.

It is an object of the disclosure to provide a lighting unit capable of preventing an occurrence of malfunction of a circuit substrate and preventing a deterioration of contact reliability at an electrical connection portion between a bus bar and the circuit substrate, even when an external force is applied to the lighting unit.

According to an embodiment, there is provided a lighting unit including: a housing; a bus bar including a base part, a first spring part and a second spring part, wherein in a state where the bus bar is installed in the housing, the base part and the first spring part are held by the housing in a first direction, and the bus bar is positioned with respect to the housing in the first direction; and a circuit substrate including a bus bar contact part, wherein in a state where the circuit substrate is installed to the bus bar installed in the housing, the bus bar contact part contacts a substrate contact part provided to the second spring part such that the circuit substrate is held by the base part and the second spring part in the first direction, and the circuit substrate is positioned with respect to the bus bar in the first direction.

According to an embodiment, an abutting part may be provided to the first spring part of the bus bar, and in the state where the bus bar is installed in the housing, the abutting part of the first spring part may abut on an abutting part of the housing such that the bus bar is prevented from coming off from the housing According to an embodiment, the lighting unit may further include a cover to be integrally installed to the housing, including an abutting part, wherein in a state where the cover is installed to the housing in which the bus bar is installed, the abutting part of the cover may prevent the abutting part of the housing from being displaced in a direction where the bus bar comes off from the housing.

According to an embodiment, the housing may include a lateral biasing part, in the state where the bus bar is installed in the housing, the lateral biasing part may position the bus bar with respect to the housing with a biasing force in a second direction, and the second direction may be a thickness direction of each of the base part, the first spring part and the second spring part formed in a flat plate shape.

According to an embodiment, the housing may include a connector receiving chamber to which a mating connector is to be fitted, the bus bar may include a tab terminal part, a surface roughness of a first pair of side surfaces facing each other in a square columnar distal end portion of the tab terminal part, may be smoother than a surface roughness of a second pair of side surfaces facing each other in the distal end portion of the tab terminal part, and in a state where the bus bar is installed in the housing, the first pair of side surfaces may be perpendicular to the first direction.

According to an embodiment, there is provided a lighting unit including: a housing; a plurality of bus bars each including a base part, a first spring part and a second spring part, wherein in a state where the bus bars are installed in the housing, the base part and the first spring part of each bus bar are held by the housing in a first direction, and each bus bar is positioned with respect to the housing in the first direction; and a circuit substrate including a plurality of bus bar contact parts, wherein in a state where the circuit substrate is installed to the bus bars installed in the housing, each bus bar contact part contacts a substrate contact part provided to the second spring part of each bus bar such that the circuit substrate is held by the base part and the second spring part of each bus bar in the first direction, and the circuit substrate is positioned with respect to the bus bars in the first direction.

According to the embodiment, it is possible to provide a lighting unit capable of preventing an occurrence of malfunction of a circuit substrate and preventing a deterioration of contact reliability at an electrical connection portion between a bus bar and the circuit substrate, even when an external force is applied to the lighting unit.

DETAILED DESCRIPTION

A lighting unit according to an exemplary embodiment will be described in detail below with reference to drawings. A lighting unit 1 is used as an indoor lamp for an automobile, for example. As illustrated in FIG. 1 to FIG. 4, the lighting unit 1 includes a housing 3, bus bars 5 and a circuit substrate 7.

For convenience of explanation, a predetermined direction (longitudinal direction) in the lighting unit is referred to as a front-rear direction, a predetermined direction (width direction) orthogonal to the front-rear direction is referred to as a lateral direction, and a direction orthogonal to the front-rear direction and the lateral direction is referred to as a height direction.

Figure 7:
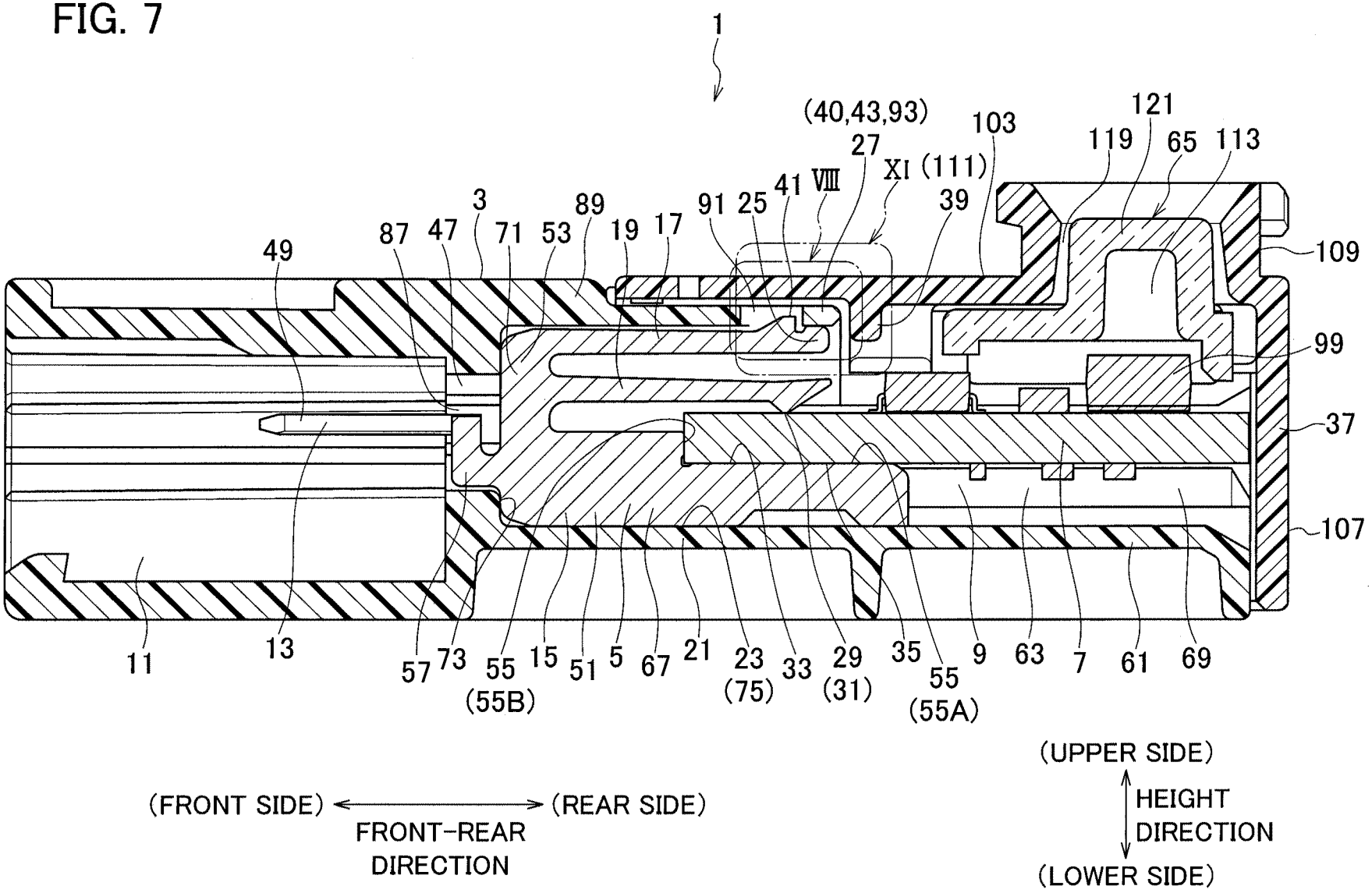
FIG. 7 is a cross-sectional view taken along a line VII-VII in FIG. 1, which is viewed from a lateral direction of the lighting unit.

As illustrated in FIG. 7 and the like, the housing 3 includes a component receiving chamber 9 and a connector receiving chamber 11 to which a mating connector (not illustrated) is to be fitted.

Figure 9A:
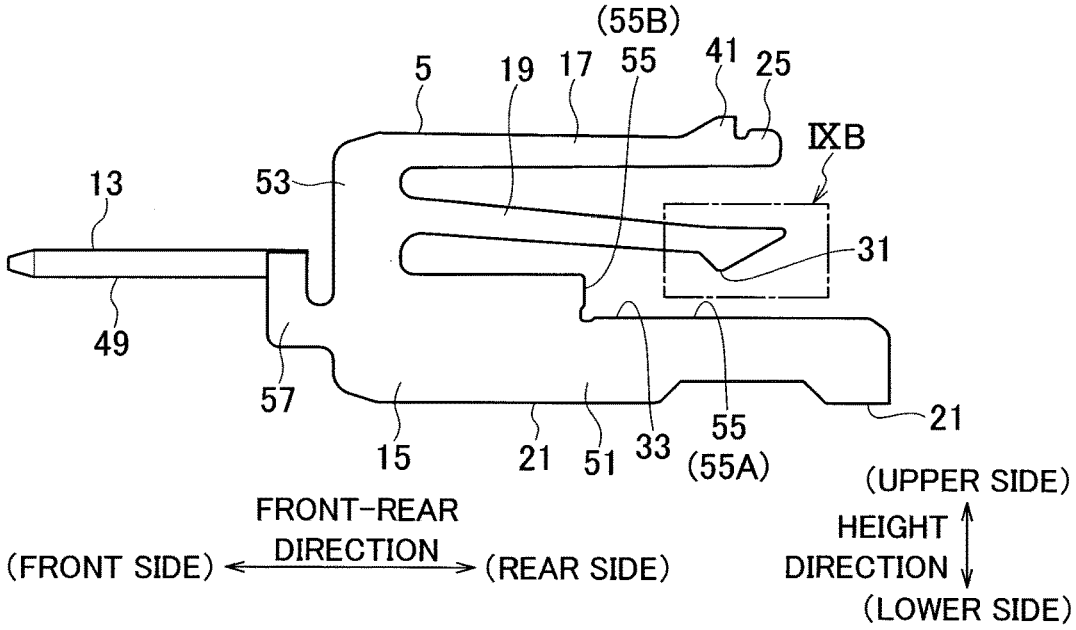
FIG. 9A is a side view of a bus bar of the lighting unit, which is viewed from the lateral direction of the lighting unit.
Figure 9B:
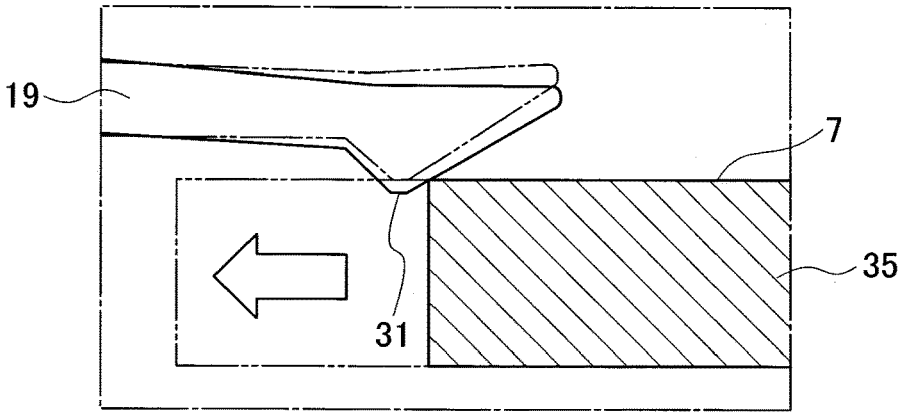
FIG. 9B is an enlarged view of a IXB portion in FIG. 9A.

As illustrated in FIG. 9A, FIG. 9B and the like, each of the bus bars 5 includes a 10 tab terminal part 13, a base part 15, a first spring part 17 and a second spring part 19. As illustrated in FIG. 7 and the like, each of the bus bars 5 is installed in the housing 3. In a state where each bus bar 5 is installed in the housing 3, at least a part of the tab terminal part 13 is arranged in the connector receiving chamber 11, and the base part 15, the first spring part 17 and the second spring part 19 are arranged in the component receiving 15 chamber 9.

In the state where each bus bar 5 is installed in the housing 3, the base part 15 and the first spring 17 are held by the housing 3 in the height direction (first direction). In the state where each bus bar 5 is installed in the housing 3, the bus bar 5 is positioned with respect to the housing 3 in the first direction and the position is held More specifically, in the state where each bus bar 5 is installed in the housing 3, a first abutting part 21 of the base part 15 of the bus bar 5 abuts on a first abutting part 23 of the housing 3. In the state where each bus bar 5 is installed in the housing 3, a first abutting part 25 of the first spring par 17 of the bus bar 5 abuts on a second abutting part 27 of the housing 3. The first abutting part 25 is provided at a distal end of the first spring part 17. By these abutments, the first spring part 17 is elastically deformed. Further, by these abutments, each bus bar 5 is held by the housing 3 with biasing force, and the bus bar 5 is positioned with respect to the housing 3 in the first direction which is the direction of the holding and the position is held.

As illustrated in FIG. 7 and the like, the circuit substrate 7 is provided with bus bar contact parts 29. The circuit substrate 7 is installed on a portion of each bus bar 5. The portion of each bus bar 5 is installed in the component receiving chamber 9 of the housing 3. When each bus bar contact part 29 contacts a substrate contact part 31 provided in the second spring part 19 of each bus bar 5, the circuit substrate 7 is held by the base part 15 and the second spring part 19 in the first direction (height direction). Further, the circuit substrate 7 is positioned with respect to the bus bars 5 and the housing 3 in the first direction.

As illustrated in FIG. 7, in a state where the circuit substrate 7 is installed on the bus bars 5 which are installed in the housing 3, the substrate contact part 31 provided at a distal end of the second spring 19 of each bus bar 5 contacts the corresponding bus bar contact part 29 of the circuit substrate 7.

Figure 10A:
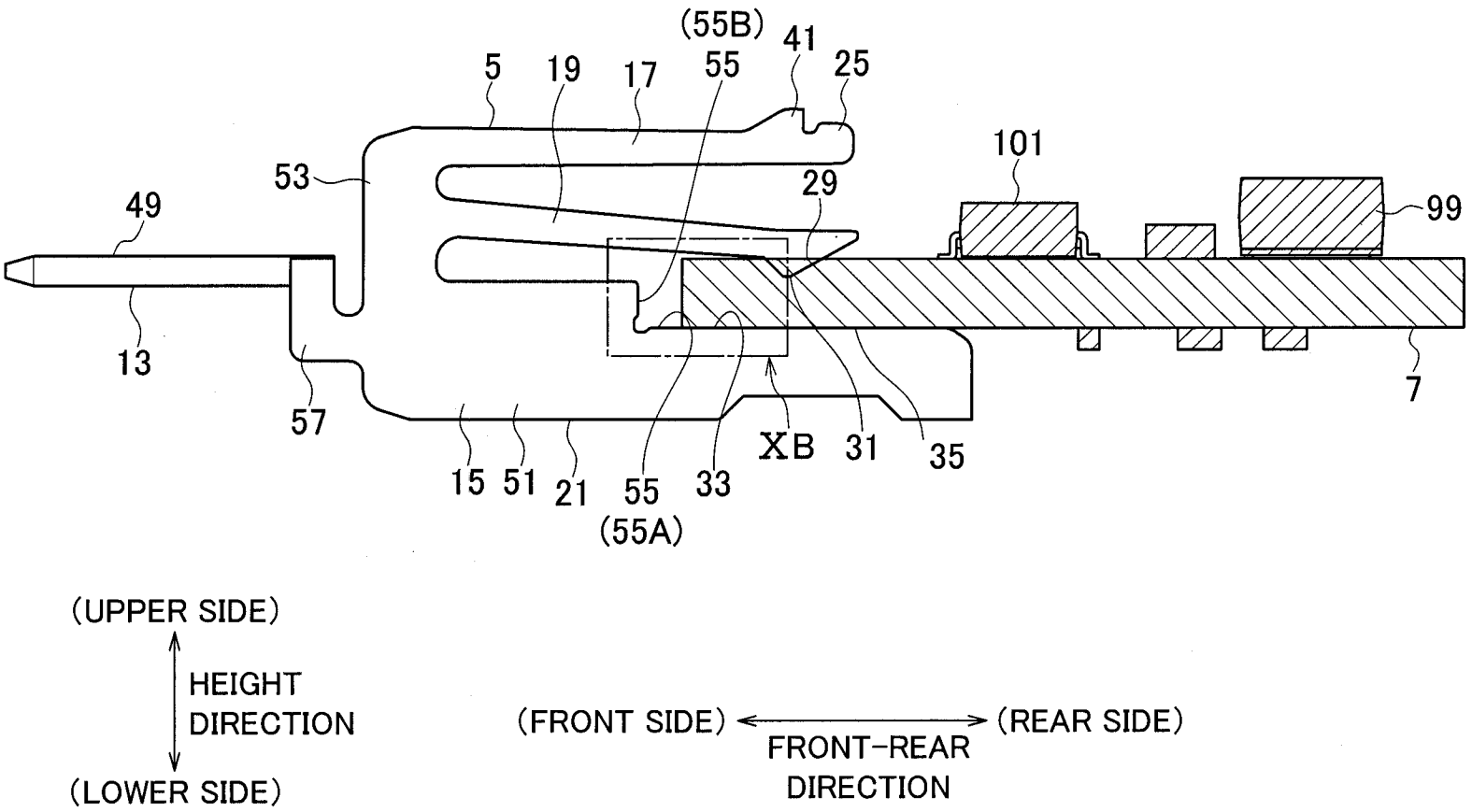
FIG. 10A is a diagram illustrating an installation mode of a circuit substrate on the bus bar of the lighting unit.
Figure 10B:
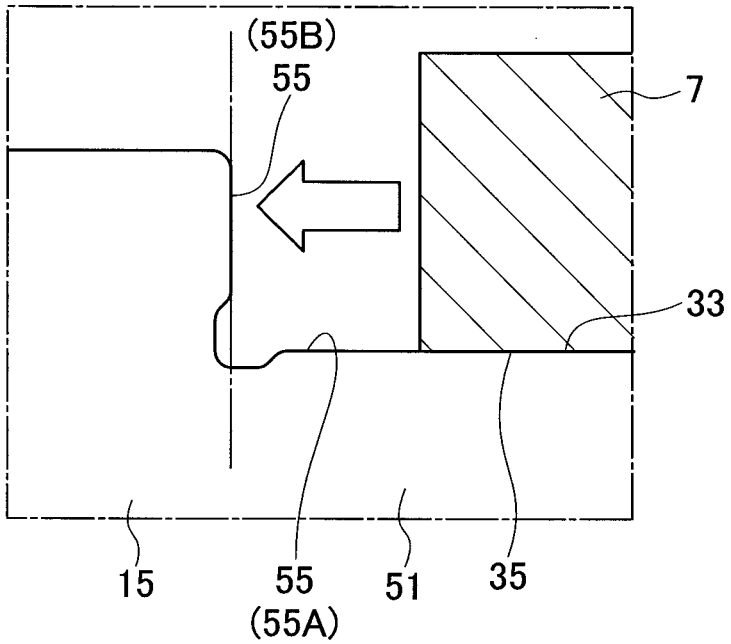
FIG. 10B is an enlarged view of a XB portion in FIG. 10A.

As illustrated in FIG. 7, FIG. 10A, FIG. 10B and the like, in a state where the circuit substrate 7 is installed on the bus bars 5 which are installed in the housing 3, a second abutting part 33 of the base part 15 of each bus bar 5 abuts on a first abutting part 35 of the circuit substrate 7. By this abutment, the second spring part 19 of each bus bar 5 is elastically deformed. Further, by this abutment, the circuit substrate 7 is held by each of the bus bars 5 with biasing force, and the circuit substrate 7 is positioned with respect to the bus bars 5 in the first direction which is the direction of the holding and the position is held.

Figure 1:
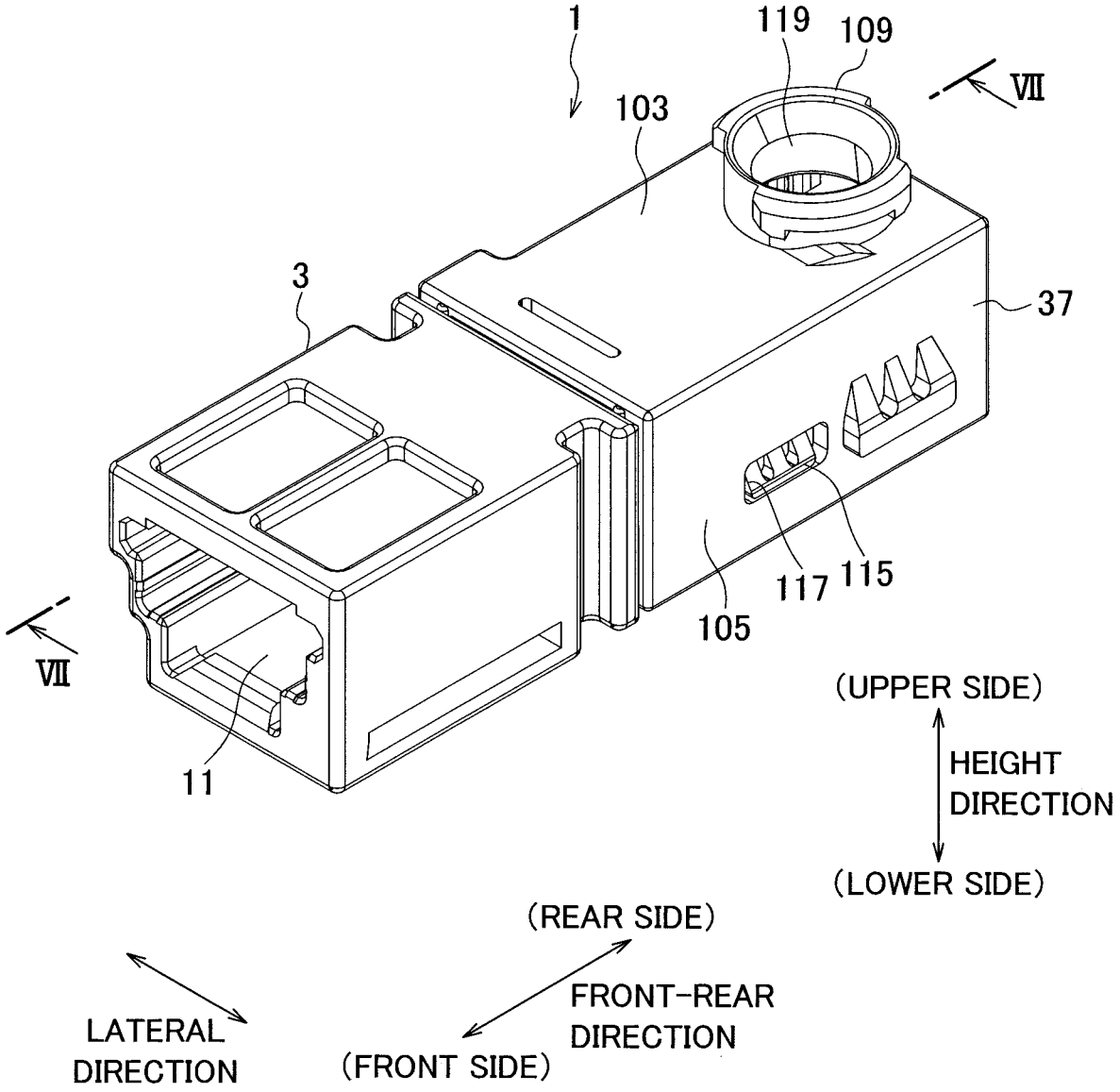
FIG. 1 is a perspective view of a lighting unit according to an embodiment of the disclosure.
Figure 2:
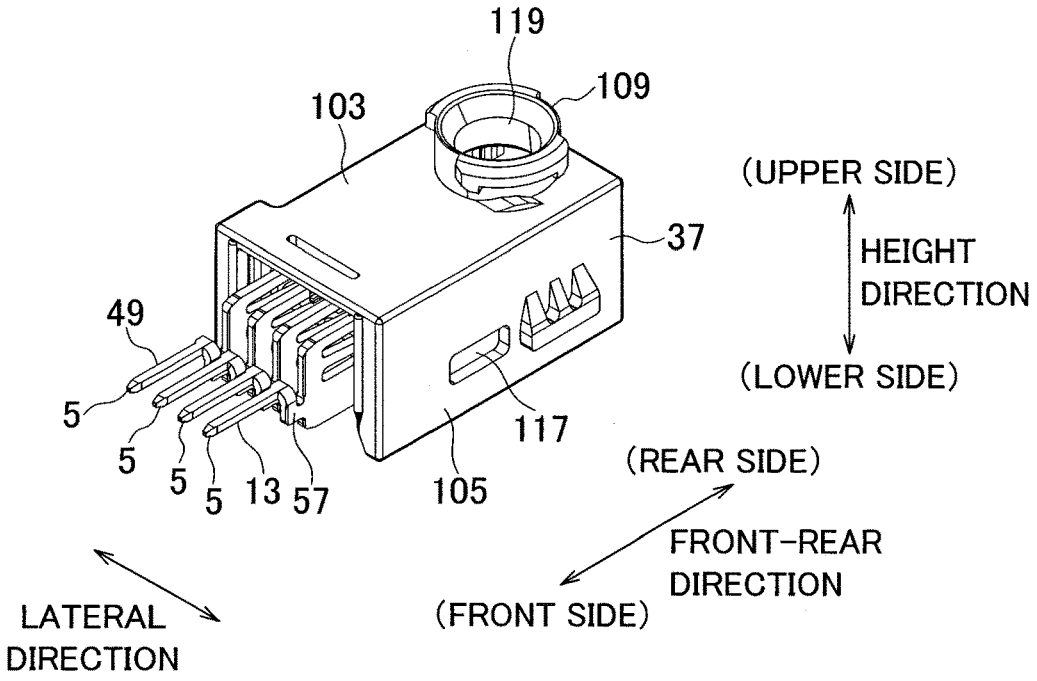
FIG. 2 is a perspective view in which a housing is removed from the lighting unit illustrated in FIG. 1.
Figure 13:
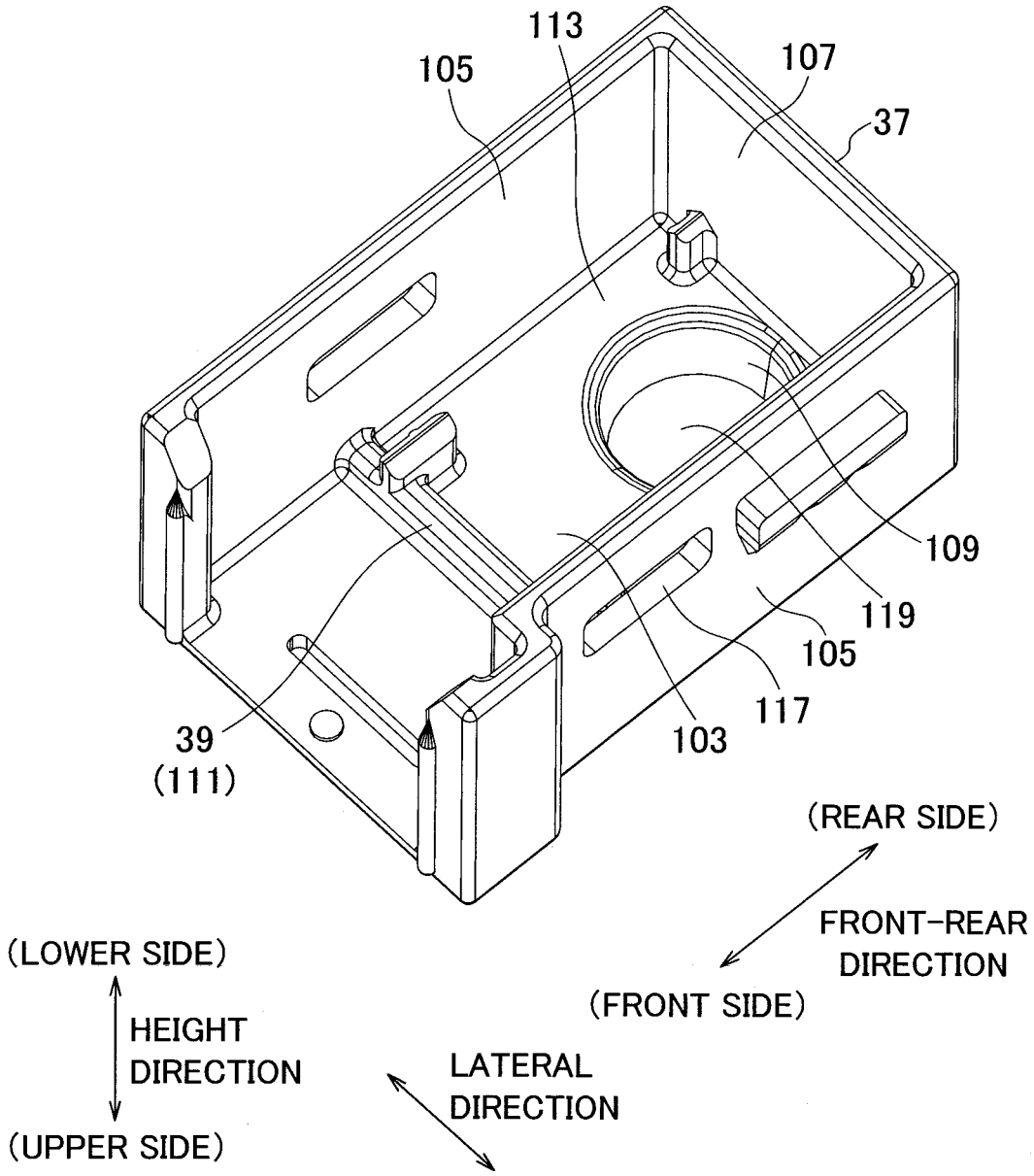
FIG. 13 is a perspective view of the cover of the lighting unit.

The lighting unit 1 includes a cover 37. As illustrated in FIG. 13 and the like, the cover 37 is provided with an abutting part (locking part) 39. As illustrated in FIG. 1, FIG. 7 and the like, the cover 37 is installed to the housing 3 in a unified manner. In the lighting unit 1, when the cover 37 is installed to the housing 3 in which the bus bars 5 and the circuit substrate 7 are installed, the abutting part 39 of the cover 37 prevents a predetermined part 40 of the housing 3 from being displaced.

The predetermined part 40 of the housing 3 is the second abutting part 27 of the housing 3 on which the first abutting part 25 of the first spring part 17 can abut. The above-described displacement occurs in a direction (first direction, more specifically, upper side of height direction) away from the first spring part 17 of each bus bar 5.

Figure 8:
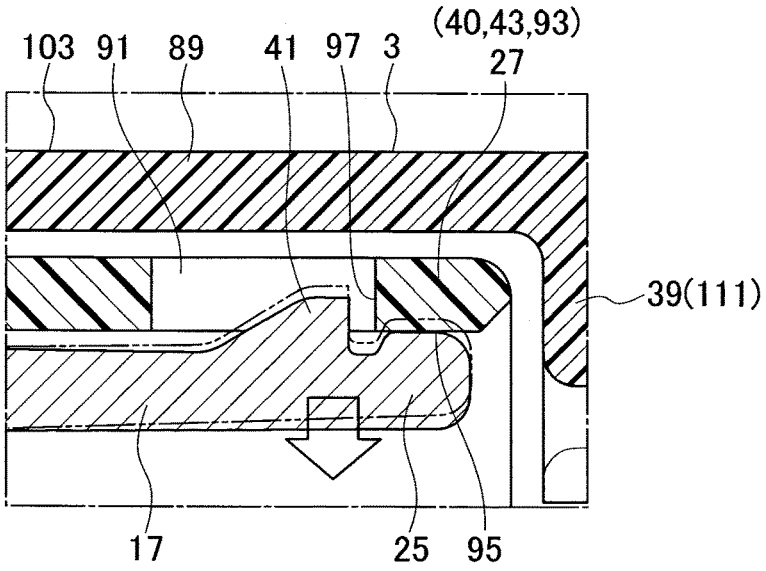
FIG. 8 is an enlarged view of a VIII portion in FIG. 7.

As illustrated in FIG. 7, FIG. 8 and the like, the first spring part 17 of each bus bar 5 is provided with a second abutting portion 41. When each bus bar 5 is installed in the housing 3, the second abutting part 41 of the first spring part 17 can abut on a third abutting part 43 of the housing 3. This abutment prevents each bus bar 5 from coming off from the housing 3.

When the bus bars 5 are installed in the housing 3, the bus bars 5, which are located at a prescribed position in a prescribed attitude where the bus bars 5 can be installed in the housing 3, are away from the housing 3 and positioned at a rear side of the housing 3. Subsequently, the bus bars 5 are moved forward with respect to the housing 3 to be inserted into the housing 3. By this insertion, the bus bars 5 are installed in the housing 3.

The first spring part 17 of each bus bar 5 has the second abutting part 41 provided near the first abutting part 25 of the first spring part 17 at the distal end of the first spring part 17. In a state where each of the bus bars 5 is installed in the housing 3, as described above, the first abutting part 25 of the first spring portion 17 abuts on the second abutting part 27 of the housing 3, and the first spring portion 17 is elastically deformed.

In a state where each of the bus bars 5 is installed in the housing 3, the second abutting part 41 of the first spring part 17 is slightly separated to a front side from the third abutting part 43 of the housing 3. Note, in the state where each of the bus bars 5 is installed in the housing 3, the second abutting part 41 of the first spring part 17 may abut on the third abutting part 43 of the housing 3. The third abutting part 43 and the second abutting part 27 of the housing 3 are adjacent or close to each other.

When the cover 37 is installed to the housing 3 in which the bus bars 5 and the circuit substrate 7 are installed, the abutting part 39 of the cover 37 prevents displacement of the third abutting part 43 of the housing 3. The third abutting part 43 of the housing 3 is a part abutting on the second abutting part 41 of the first spring part 17 for preventing each bus bar 5 from coming off of from the housing 3. A direction of the above-described displacement is a direction (backward direction) in which each bus bar 5 comes off from the housing 3.

The base part 15, the first spring part 17, and the second spring part 19 of each bus bar 5 are formed in a flat plate shape having a predetermined thickness. The thickness directions of the base part 15, the first spring part 17 and the second spring part 19 coincide with a second direction which is the lateral direction.

Figure 6:
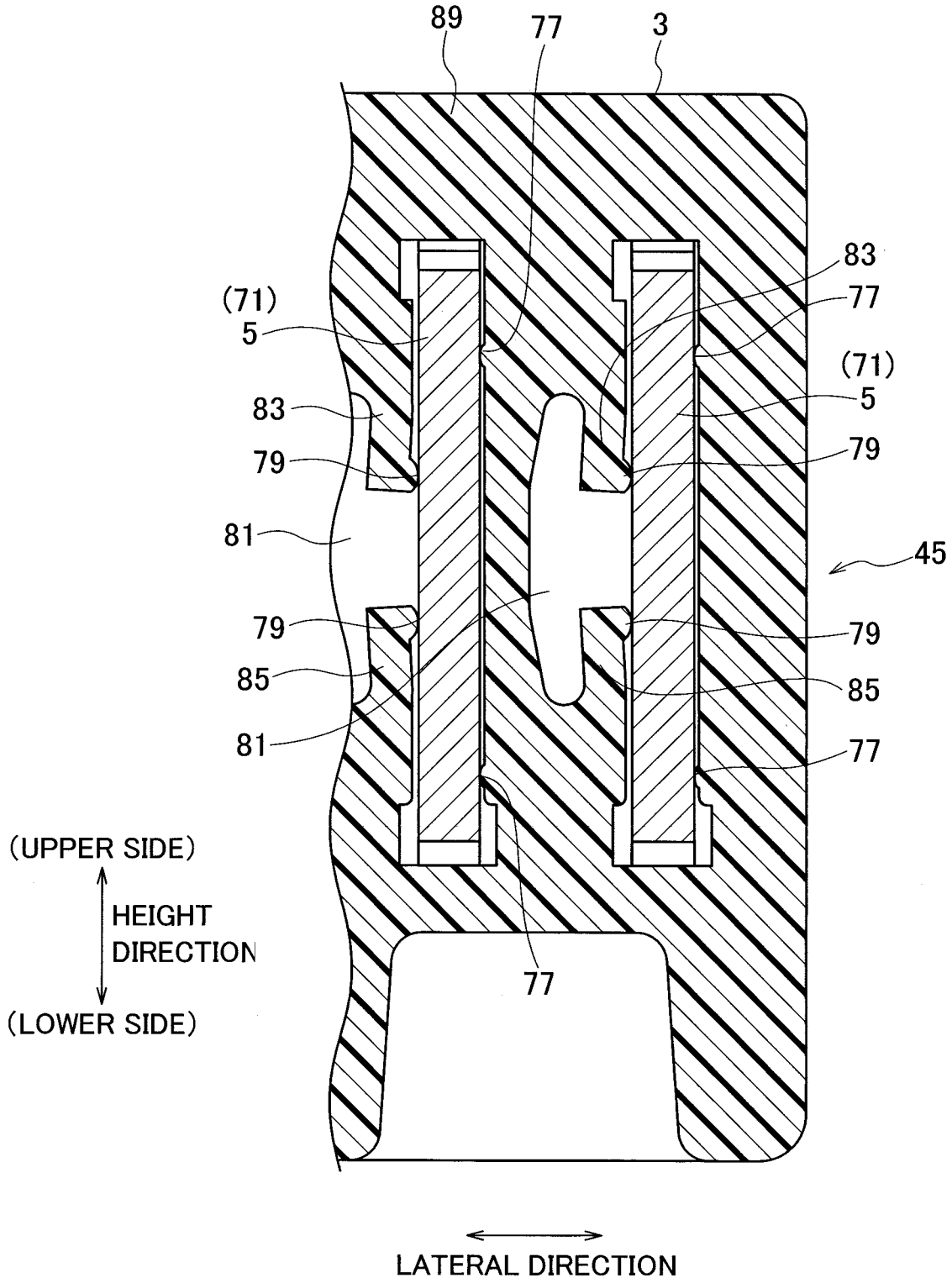
FIG. 6 is an enlarged view of a VI portion in FIG. 5, which is viewed from a front-rear direction of the lighting unit.

When each bus bar 5 is installed in the housing 3, the bus bar 5 is positioned with respect to the housing 3 with biasing force in the second direction. That is, as illustrated in FIG. 6 and the like, the housing 3 is provided with a lateral biasing part 45 for biasing.

There are provided the bus bars 5. The circuit substrate 7 is provided with the bus bar contact parts 29. The bus bar contact parts 29 respectively contact the substrate contact parts 31, which holds the circuit substrate 7 between the bus bars 5 at a plurality places separated from each other. The number of the bus bars 5 is four, for example. Note that the number of bus bars 5 may be one, two, three or more than four.

The respective bus bars 5 are formed in the same shape. In a state where each bus bar 5 is installed in the housing 3, the thickness direction of the base part 15, the first spring part 17 and the second spring part 19 of the bus bar 5 is the lateral direction. In a state where the respective bus bars 5 are installed in the housing 3, the respective bus bars 5 are arranged in the lateral direction at prescribed intervals. When a state where the respective bus bars 5 are installed in the housing 3 is viewed from the lateral direction, all of the bus bars 5 overlap each other.

The housing 3 is provided with a partition wall 47 in addition to the component receiving chamber 9 and the connector receiving chamber 11. The partition wall 47 separates the component receiving chamber 9 and the connector receiving chamber 11. The component receiving chamber 9, the partition wall 47 and the connector receiving chamber 11 are arranged in this order from a rear side to a front side in the front-rear direction.

A distal end portion 49 of the tab terminal part 13 protrudes in the connector receiving chamber 11 when each bus bar 5 is installed in the housing 3. The distal end portion 49 of the tab terminal part 13 is formed in a square columnar shape. A surface roughness of a first pair of side surfaces (both side surfaces in a vertical direction) facing each other in the distal end portion 49 of the tab terminal part 13, is smoother than that of a second pair of side surfaces (both side surfaces in the lateral direction) facing each other in the distal end portion 49 of the tab terminal part 13.

When each bus bar 5 is installed in the housing 3, the first pair of side surfaces facing each other in the distal end portion 49 of the tab terminal part 13 is perpendicular to the first direction (height direction).

A surface roughness of both surfaces of each of the base part 15, the first spring part 17, and the second spring part 19 of each bus bar 5 in the thickness direction, is equal to that of the first pair of side surfaces facing each other in the distal end portion 49 of the tab terminal part 13. A terminal of the mating connector is brought into contact with the first pair of side surfaces facing each other in the distal end portion 49 of the tab terminal part 13, so as to be electrically connected to each bus bar 5.

More specifically, each bus bar 5 is manufactured from a flat metal material having smooth surface roughness on both surfaces in the thickness direction. First, a flat material is processed so as to have a predetermined shape when viewed from the thickness direction. In the processed semi-finished product state, a surface roughness in the thickness direction is smoother than that of an outer peripheral surface of the predetermined shape. Further, in the semi-finished product state in which the above-described processing has been performed, a part to be the tab terminal part 13 is formed into a square columnar shape and protrudes from the base part 15 in an elongated shape.

In the semi-finished product state, each bus bar 5 is obtained by plastically deforming the semi-finished product at a base end portion of the tab terminal part 13 such that a portion to be the distal end portion 49 of the tab terminal part 13 is rotated by 90 degrees with respect to the base part 15. The angle of 90 degrees is an angle when the square columnar part to be the tab terminal part 13 is viewed from the height direction of the square columnar part.

Next, the lighting unit 1 will be described in more detail.

As illustrated in FIG. 9A, FIG. 9B, FIG. 10 A, FIG. 10 B, and the like, the base part 15 of each bus bar 5 is substantially formed in an L letter shape having a rectangular first portion 51 which extends in the front-rear direction and a rectangular second portion 53 which extends in the height direction, when viewed from the lateral direction. The second portion 53 extends upward from a front end of the first portion 51.

The first spring part 17 projects rearward from an upper end of the second portion 53 when viewed from the lateral direction, and is formed in a cantilever shape to be slightly bent in the height direction. At a rear end of the first spring part 17, the first abutting part 25 and the second abutting part 41 of the first spring part 17 are formed. The first abutting part 25 and the second abutting part 41 of the first spring part 17 are formed at an upper end of a rear end portion of the first spring portion 17.

The first abutting part 25 of the first spring part 17 has a small plane perpendicular to the height direction when viewed from the lateral direction. The second abutting part 41 of the first spring part 17 has a small plane perpendicular to the front-rear direction when viewed from the lateral direction. When viewed from the lateral direction, an L-letter shape is substantially formed by a line segment forming a part of the plane of the first abutting part 25 of the first spring part 17 and a line segment forming a part of the plane of the second abutting part 41 of the first spring part 17. Further, when viewed from the lateral direction, the plane of the first abutting part 25 of the first spring part 17 faces upward, and the plane of the second abutting part 41 of the first spring part 17 faces rearward.

When viewed from the lateral direction, the second spring part 19 projects rearward from a middle portion of the second portion 53, and is formed in a cantilevered shape to be slightly bent in the height direction. At a rear end of the second spring part 19, the substrate contact part 31 of the second spring part 19 is formed. The substrate contact part 31 is substantially formed in a triangular shape. A lower end of the substrate contact part 31 is one corner portion of the triangular shape.

In the first portion 51 of the base part 15, as illustrated in FIG. 10A and FIG. 10B, a circuit substrate abutting part 55 is formed. When viewed from the lateral direction, the circuit substrate abutting part 55 is formed at a rear end of the first portion 51. When viewed from the lateral direction, the circuit substrate abutting part 55 is also formed at an upper end of the first portion 51. When viewed from the lateral direction, the circuit substrate abutting part 55 is formed by two small planes 55A and 55B.

The plane 55A is perpendicular to the height direction. The plane 55B is perpendicular to the front-rear direction. When viewed from the lateral direction, the line segment forming a part of the plane 55A and the line segment forming a part of the plane 55B substantially form an L-letter shape. When viewed from the lateral direction, the plane 55A faces upward and the plane 55B faces rearward.

When viewed from the lateral direction, a length of the first spring part 17 extending from the second portion 53 of the base part 15 is substantially equal to a length of the second spring part 19 extending from the second portion 53 of the base part 15. On the other hand, a length of the first portion 51 extending from the second portion 53 of the base part 15 is larger than a length of the first spring part 17 extending from the second portion 53 of the base part 15.

A value of a distance between the second portion 53 of the base part 15 and the plane 55 B of the circuit substrate abutting part 55 in the front-rear direction is smaller than a value of a distance between the second portion 53 of the base part 15 and the lower end of the substrate contact part 31 in the front-rear direction.

When viewed from the lateral direction, the tab terminal part 13 projects forward from a lower side of the second portion 53 of the base part 15, with respect to the second portion 53. The tab terminal part 13 includes a base end portion 57 and the distal end portion 49. When viewed from the lateral direction, the base end portion 57 is substantially formed in an L-letter shape. The distal end portion 49 projects forward from the base end portion 57. When viewed from the lateral direction, the distal end portion 49 of the tab terminal part 13 is located at a middle portion of the second portion 53 of the base part 15 in the height direction.

The housing 3 is made of a material such as a synthetic resin which does not transmit light. The outer shape of the housing 3 is a rectangular parallelepiped. The partition wall 47 is provided between the component receiving chamber 9 and the connector receiving chamber 11 of the housing 3. The connector receiving chamber 11 may be referred to as a connector fitting chamber.

Figure 12:
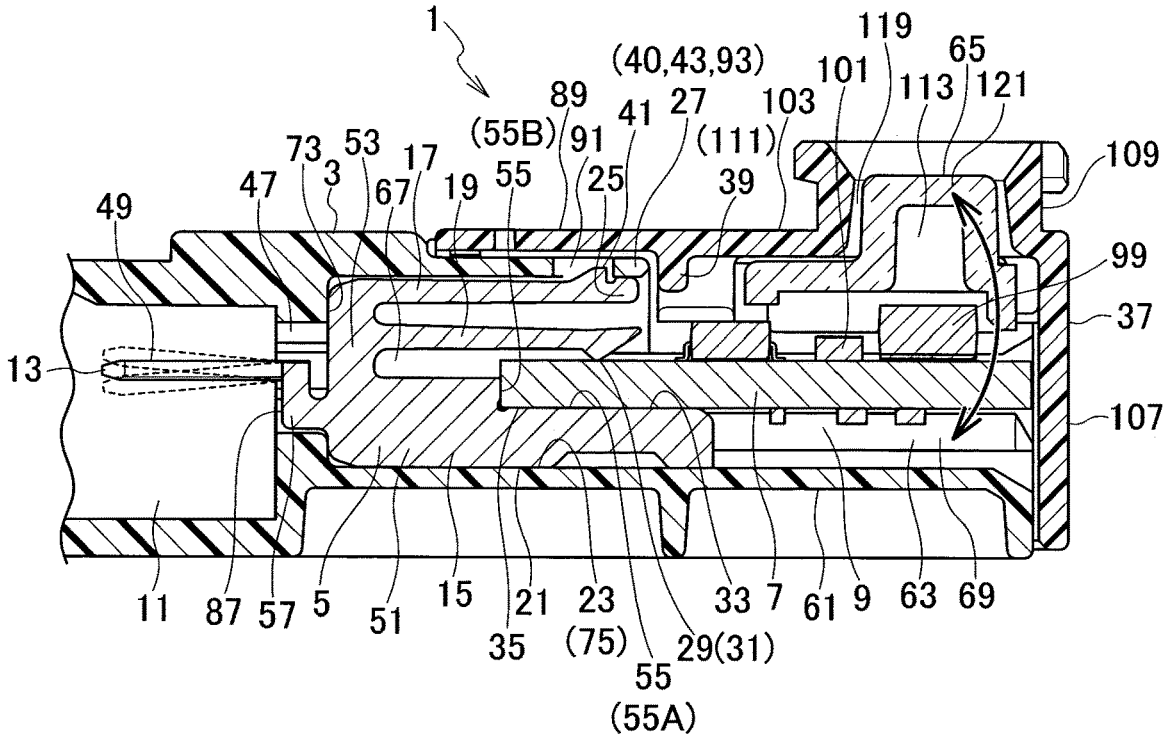
FIG. 12 is a cross-sectional view taken along a line VII-VII in FIG. 1, which is view from the lateral direction of the lighting unit, and illustrates a wobble of the bus bar.

The component receiving chamber 9 is surrounded by a bottom wall 61, a pair of sidewalls 63 and the partition wall 47. The component receiving chamber 9 includes a front side portion 67 and a rear side portion 69. In the rear side portion 69, an upper surface and a rear surface thereof are opened. The opening is closed by a lens cover 65 (See FIG. 12, etc.).

Figure 5:
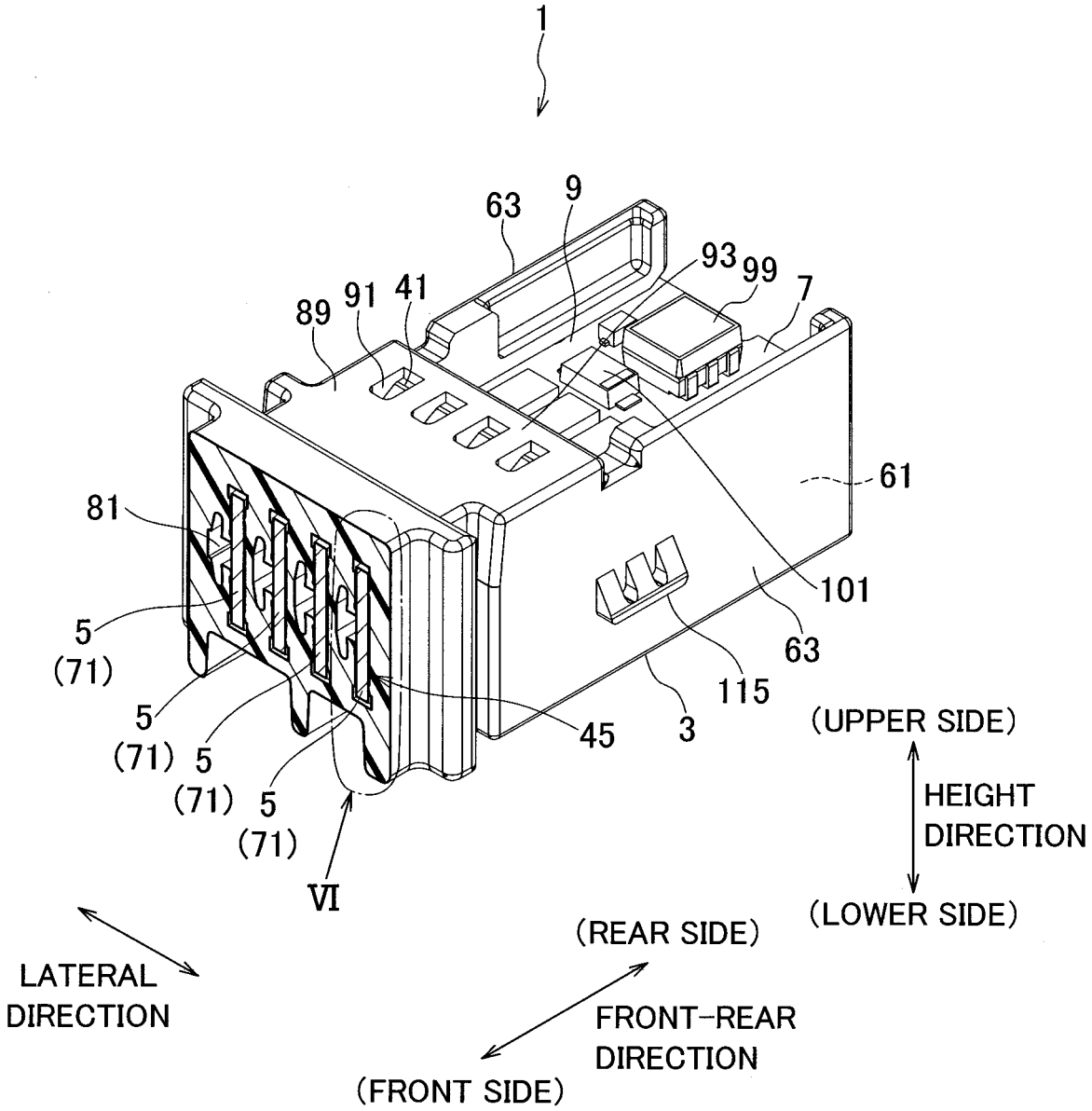
FIG. 5 is a perspective view that illustrates a section of an assembly illustrated in FIG. 3.

As illustrated in FIG. 5 and FIG. 6, bus bar guide parts 71 are provided to the front side portion 67 and a front end of the rear side portion 69 The number of bus bar guide parts 71 is equal to the number of bus bars 5. The bus bar guide parts 71 are hollow, and when the bus bars 5 are installed in the housing 3, each of the bus bars 5 enters the corresponding bus bar guide part 71.

As illustrated in FIG. 6 and FIG. 7, each bus bar guide part 71 is provided with a front-rear directional abutting surface 73, a height directional abutting surface 75 and the lateral biasing part 45. The front-rear directional abutting surface 73 is formed by a part of the partition wall 47, for example, and has a small plane facing a rear side. In a state where the bus bars 5 are installed in the housing 3, the second portion 53 of the base part 15 of each bus bar 5 abuts on the front-rear directional abutting surface 73 such that the bus bars 5 cannot move further forward with respect to the housing 3.

The height directional abutting surface 75 is formed at the front side portion 67 and the front end of the rear side portion 69, and has a plane facing an upper side. In a state where the bus bars 5 are installed in the housing 3, the first portion 51 of the base part 15 of each bus bar 5 abuts on the height directional abutting surface 75 such that the bus bars 5 cannot move further downward with respect to the housing 3.

The lateral biasing part 45 is formed at the front side portion 67 of the component receiving chamber 9. As illustrated in FIG. 6 and the like, a lateral dimension of each bus bar guide part 71 in the front side portion 67 is slightly larger than a lateral dimension (a dimension in the thickness direction) of the base part 15, the first spring part 17, and the second spring part 19 of each bus bar 5.

On a right side wall surface of the front side portion 67, which is one wall surface of each bus bar guide part 71 in FIG. 6, a plurality of projections 77 are provided. The projections 77 are separated from each other in the height direction. In a state where the bus bars 5 are installed in the housing 3, the second portion 53 of the base part 15 of each bus bar 5 abuts on the projections 77. Note in addition to the protrusions 77 separated from each other in the height direction, other protrusions 77 separated from each other in the front-rear direction may be provided. In this case, in a state where the bus bars 5 are installed in the housing 3, the first portion 51 and the second portion 53 of the base part 15 of each bus bar 5 abut on the projections 77.

On a left side wall surface of the front side portion 67, which is the other wall surface of each bus bar guide part 71 in FIG. 6, a plurality of projections 79 are provided. The projections 79 are separated from each other in the height direction. In a state where the bus bars 5 are installed in the housing 3, the second portion 53 of the base part 15 of each bus bar 5 abuts on the projections 79. Note, in addition to the protrusions 79 separated from each other in the height direction, other protrusions 79 separated from each other in the front-rear direction may be provided. In this case, in a state where the bus bars 5 are installed in the housing 3, the first portion 51 and the second portion 53 of the base part 15 of each bus bar 5 abut on the projections 79.

In the height direction, the projections 79 are positioned between the projections 77 arranged an upper side and a lower side of the housing 3. For example, as illustrated in FIG. 6, two projections 79 are positioned between the upper projection 77 and the lower projection 77.

Each bus bar 5 abutting on the projections 79 is pressed to a right side in FIG. 6. This configuration forms the lateral biasing part 45. In a state where the bus bars 5 are installed in the housing 3, each bus bar 5 is held by the housing 3 with biasing force in the lateral direction, which positions the bus bar 5 in the lateral direction with respect to the housing 3.

The lateral biasing by the projections 79 will be further described. As illustrated in FIG. 6, a T-letter shaped cavity portion 81 is formed in each thick portion of the housing 3 where the projections 79 are formed. By this configuration, an elastic flat upper side wall portion 83 and an elastic flat lower side wall portion 85 are provided on a left side of each bus bar guide part 71. The upper projection 79 illustrated in FIG. 6 is provided at a lower end of the upper side wall portion 83. The lower projection 79 illustrated in FIG. 6 is provided at an upper end of the lower side wall portion 85. Thus, the lateral biasing force by the projections 79 is obtained by the elasticity of the upper side wall portion 83 and the elasticity of the lower side wall portion 85.

As illustrated in FIG. 7 and the like, the partition wall 47 is provided with a plurality of through holes 87. When the bus bars 5 are installed in the housing 3, the base end portion 57 of the tab terminal part 13 of each bus bar 5 penetrates through each through hole 87, and the distal end portion 49 of the tab terminal part 13 projects into the connector receiving chamber 11.

Figure 3:
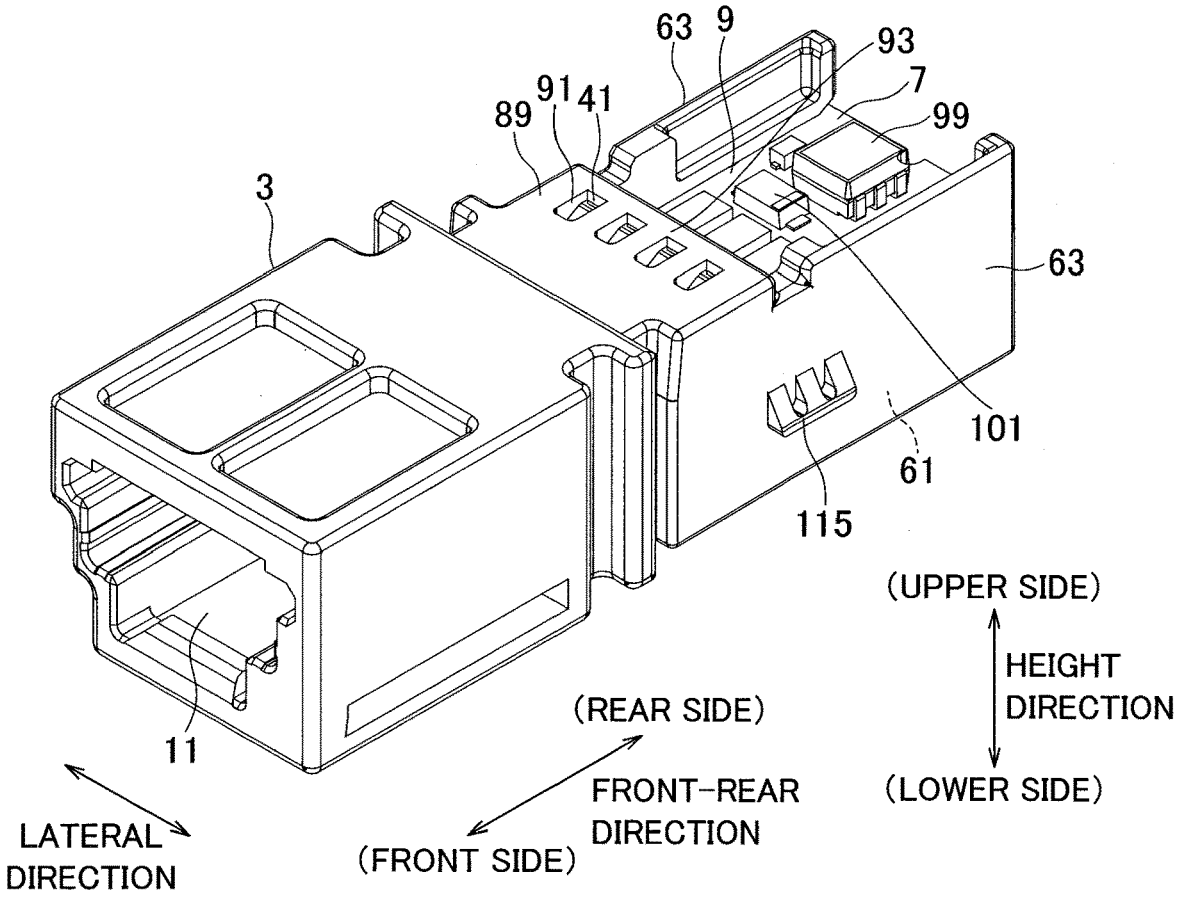
FIG. 3 is a perspective view in which a cover is removed from the lighting unit illustrated in FIG. 1.

As illustrated in FIG. 3, FIG. 7 and the like, in the front side portion 67 of the component receiving chamber 9, an upper wall portion 89 above the bus bar guide parts 71 is provided with a plurality of small rectangular parallelepiped through holes 91. The number of through holes 91 is equal to the number of the bus bars 5. The through holes 91 are provided near a rear end of the rear side portion 69 of the component receiving chamber 9, and are arranged at predetermined intervals in the lateral direction.

As illustrated in FIG. 8, since the through holes 91 are formed, hooking portions 93 are respectively formed adjacent to the through holes 91 at rear sides of the through holes 91. Each hooking portion 93 is formed by a part of a thick portion of the housing 3, and is formed in a small rectangular shape when viewed from the lateral direction. When viewed from the lateral direction, a small plane 95 facing downward is formed at a lower end of each hooking portion 93, and a small plane 97 facing forward is formed at a front end of each hooking portion 93.

In a state where the bus bars 5 are installed in the housing 3, the first abutting part 25 of the first spring part 17 of each bus bar 5 abuts on the corresponding plane 95, and the first spring part 17 is elastically deformed to be bent downward. Further, the first abutting part 21 of the base part 15 of each bus bar 5 abuts on the bottom wall 61 of the component receiving chamber 9. Thus, each bus bar 5 is held by the housing 3 with a biasing force in the height direction, which positions the bus bar 5 in the height direction with respect to the housing 3.

Figure 11:
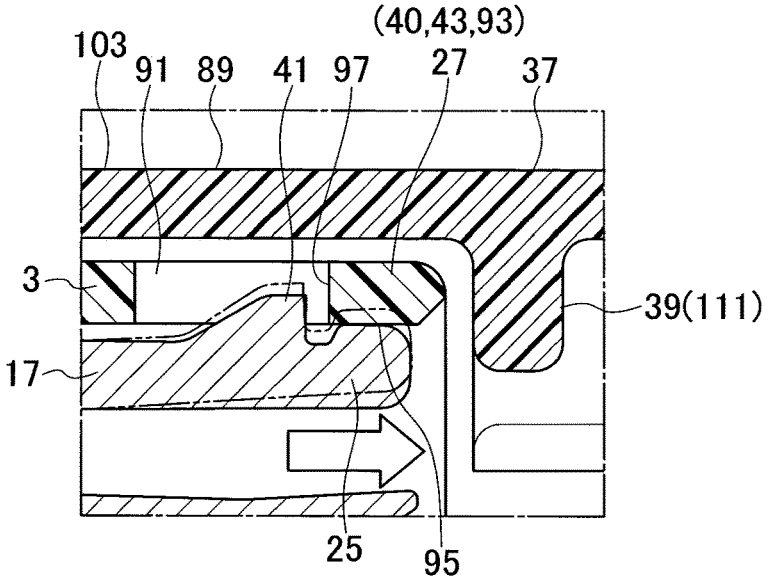
FIG. 11 is an enlarged view of a XI portion in FIG. 7 illustrating a mode of double locking by the cover of the lighting unit.

In a state where the bus bars 5 are installed in the housing 3, while the second portion 53 of the base part 15 of each bus bar 5 abuts on the partition wall 47, the second abutting part 41 of the first spring part 17 of each bus bar 5 is slightly separated from the third abutting part 43 of the housing 3 in the front-rear direction as illustrated in FIG. 8 and FIG. 11. Thus, the bus bars 5 are slightly movable in the front-rear direction with respect to the housing 3.

Figure 4:
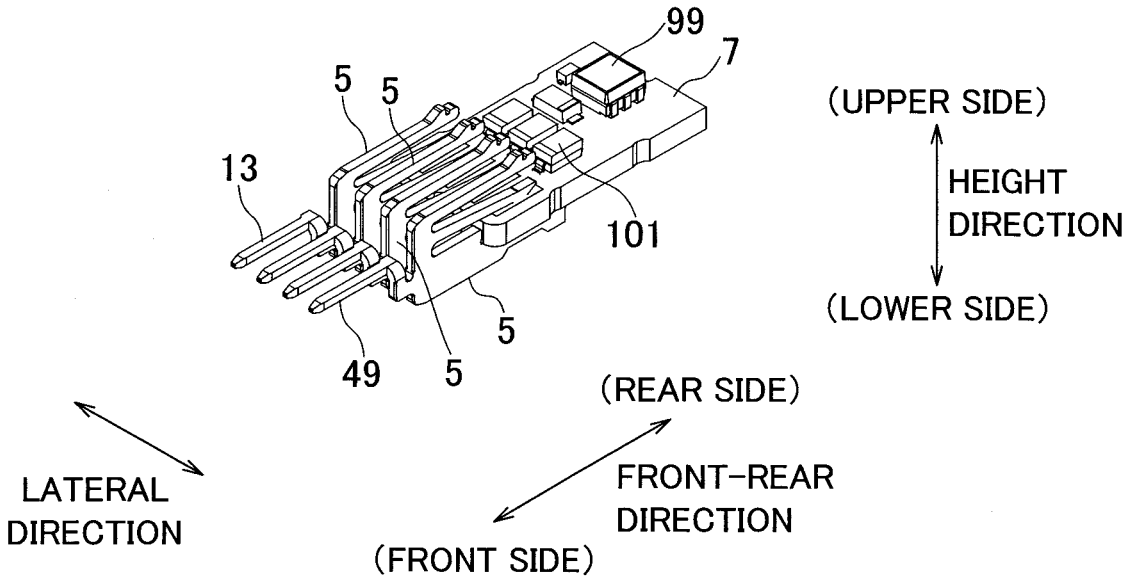
FIG. 4 is a perspective view in which the housing and the cover is removed from the lighting unit illustrated in FIG. 1.

The circuit substrate 7 is formed in a rectangular flat plate shape, and the thickness direction of the circuit substrate 7 corresponds to the height direction. As illustrated in FIG. 4 and the like, a light emitting diode 99 serving as a light source and other electronic components 101 are mounted on an upper surface of the circuit substrate 7. A circuit pattern (not illustrated) is provided on the circuit substrate 7. The mounted electronic components 101 and the circuit pattern constitute a driving circuit of the light emitting diode 99.

The bus bar contact parts 29 are provided on the upper surface of the circuit substrate 7. The number of bus bar contact parts 29 is equal to the number of bus bars 5.

In a state where the circuit substrate 7 is installed on the bus bars 5 which are installed in the housing 3, a front surface of the circuit substrate 7 abuts on the plane 55B of the circuit substrate abutting part 55 provided on the first portion 51 of the base part 15 of each bus bar 5. In a state where the circuit substrate 7 is installed on the bus bars 5 which are installed in the housing 3, a lower surface of the circuit substrate 7 abuts on the plane 55A of the circuit substrate abutting part 55 provided on the first portion 51 of the base part 15 of each bus bar 5.

By the abutment of the front surface of the circuit substrate 7 on the plane 55 B, the circuit substrate 7 cannot move further forward with respect to the housing 3. By the abutment of the lower surface of the circuit substrate 7 on the plane 55A, the circuit substrate 7 cannot move further downward with respect to the housing 3.

In a state where the circuit substrate 7 is installed on the bus bars 5 which are installed in the housing 3, the substrate contact part 31 of the second spring part 19 of each bus bar 5 contacts the corresponding bus bar contact part 29 of the circuit substrate 7. At this time, the second spring portion 19 of each bus bar 5 is elastically deformed to press the circuit substrate 7 downward. Thus, the circuit substrate 7 is held by the bus bars 5 in the height direction, and the circuit substrate 7 is positioned in the height direction with respect to the bus bars 5 and the housing 3. Further, the bus bar contact part 29 of the circuit substrate 7 and the substrate contact portion 31 of the second spring portion 19 of each bus bar 5 are in contact with each other, whereby each bus bar 5 is electrically connected to the circuit pattern of the circuit substrate 7.

Since the circuit substrate 7 is held by the bus bars 5 in the height direction when the circuit board 7 is installed on the bus bars 5 which are installed in the housing 3, the circuit substrate 7 can hardly be moved with respect to the bus bars 5 in the front-rear direction and the lateral direction.

As illustrated in FIG. 1, FIG. 13, and the like, the cover 37 includes a rectangular upper wall 103, a pair of rectangular sidewalls 105, a rectangular rear wall 107, and a cylindrical part 109.

The outer shape of the cover 37 is a rectangular parallelepiped, but a lower surface and a front surface of the cover 37 are open. An internal space 113 is formed inside the cover 37. A laterally elongated projection 111 is provided on a surface of the cover 37 at the inner space 113 side of the upper wall 103. The projection 111 is positioned slightly forward of the center in the front-rear direction. The projection 111 forms the abutting part 39 of the cover 37.

As illustrated in FIG. 3, a pair of locking projections 115 is provided on outer surfaces of lateral ends of the housing 3. As illustrated in FIG. 13, a pair of through holes 117 is provided on the pair of sidewalls 105 of the cover 37.

In a state where the cover 37 is being installed to the housing 3, the pair of locking projections 115 of the housing 3 abuts on the pair of sidewalls 105 of the cover 37, which elastically deforms and bents the pair of sidewalls 105 of the cover 37 outward.

As illustrated in FIG. 1, in a state where the cover 37 has been installed to the housing 3, the pair of locking projections 115 enters the pair of through holes 117 provided on the pair of sidewalls 105 of the cover 37, which restores the pair of sidewalls 105 of the cover 37. Thus, the cover 37 and the housing 3 are integrated.

In a state where the cover 37 is installed to the housing 3, a rear surface of the component receiving chamber 9 is closed, and the circuit substrate 7 installed in the housing 3 via the bus bars 5 is prevented from coming off from the housing 3 rearward.

The projection 111 forming the abutting part 39 of the cover 37 and the hooking portions 93 formed by the through holes 91 of the upper wall portion 89 will be described.

As illustrated in FIG. 11 and the like, when viewed from the lateral direction, the projection 111 is formed in a rectangular shape, and the hooking portion 93 is also formed in a rectangular shape. When viewed from the lateral direction, in a state where the cover 37 is installed to the housing 3 in which the bus bars 5 and the circuit substrate 7 are installed, the projection 111 is slightly separated from each hooking portion 93 rearward. When viewed from the lateral direction, the positions of each hook portion 93 and the first spring part 17 substantially coincide with the position of the projection 111 in the height direction. Thus, even when the bus bars 5 are moved rearward with respect to the housing 3 such that the hooking portions 93 are bent rearward, the hooking portions 93 abut on the projection 111, which prevents the hooking portions 93 from further deforming rearward.

When viewed from the lateral direction, in a state where the cover 37 is installed to the housing 3 in which the bus bars 5 and the circuit substrate 7 are installed, the upper wall 103 of the cover 37 is slightly separated from the hooking parts 93 upward. Thus, even when the first spring portion 17 of each bus bar 5 is moved upward such that each hooking portion 93 bends upward, each hooking portion 93 abuts on the upper wall 103 of the cover 37, which prevents the hooking portions 93 from further deforming upward.

The cylindrical part 109 of the cover 37 is located at a center of the upper wall 103 in the lateral direction, and is located at a rear side of the upper wall 103 in the front-rear direction. The cylindrical part 109 projects upward from an upper surface of the upper wall 103. At a portion of the upper wall 103 where the cylindrical portion 109 is provided, a through hole 119 is formed. The through hole 119 communicates with a cylindrical space inside the cylindrical part 109.

The lens cover 65 is integrally provided with the cover 37 such that a member 121, which is a part of the lens cover 65, enters the through hole 119 and the cylindrical space inside the cylindrical part 109.

The position of the light emitting diode 99 and the position of the cylindrical part 109 coincide with each other in the lateral direction and the front-rear direction. The light emitted from the light emitting diode 99 passes through the member 121 and then is emitted from the cylindrical part 109 of the cover 37 upward.

Next, a procedure of assembling the lighting unit 1 will be described below. The four bus bars 5 are held by a chuck jig (not illustrated), and then each bus bar 5 is inserted into the component receiving chamber 9 of the housing 3 with the tab terminal part 13 as a tip of the bus bar 5. Insertion of each bus bar 5 is performed by using the bus bar guide part 71 as a guide, and is completed when the second portion 53 of the base part 15 of each bus bar 5 abuts on the partition wall 47.

Subsequently, the circuit substrate 7 is installed on the bus bars 5 which are installed in the housing 3. This installation is performed by (1) positioning the circuit substrate 7 on a rear side of the bus bars 5, (2) bringing the circuit substrate 7 into contact with an upper surface of the plane 55 A of the circuit substrate abutting part 55 of each bus bar 5, which is perpendicular to the height direction, and (3) moving the circuit substrate 7 forward with respect to the bus bars 5 to insert the circuit substrate 7 into the housing 3.

The above-described insertion is completed when a front end of the circuit substrate 7 abuts on the plane 55 B of the circuit substrate abutting part 55 of each bus bar 5, which is perpendicular to the front-rear direction.

Subsequently, the cover 37 provided with the lens cover 65 is installed to the housing 3 in which the bus bars 5 and the circuit board 7 are installed.

Next, the operation of the lighting unit 1 will be described below. First, a mating connector is inserted into the connector receiving chamber 11 of the lighting unit 1 to electrically connect a terminal of the mating connector to the tab terminal part 13 of each bus bar 5.

Subsequently, when a power and a signal indicating a predetermined light emitting pattern of the light emitting diode 99 are sent from the mating connector, the light emitting diode 99 of the lighting unit 1 emits light in the predetermined light emitting pattern.

In the lighting unit 1, each bus bar 5 includes the base part 15, the first spring part 17 and the second spring part 19. In the lighting unit 1, in a state where each bus bar 5 is installed in the housing 3, the base part 15 and the first spring part 17 are held (sandwiched) by the housing 3 and positioned with respect to the housing 3 in the height direction.

In the lighting unit 1, in a state where the circuit substrate 7 including the bus bar contact parts 29 is installed on the bus bars 5, each of the bus bar contact parts 29 abuts on the substrate contact part 31 provided on the second spring part 19 of each of the bus bars 5. Then, the circuit substrate 7 is held (sandwiched) by the base part 15 and the second spring portion 19 of each of the bus bars 5 in the height direction, and positioned with respect to the bus bars 5 and the housing 3 in the height direction.

With this configuration, even when an external force is applied to the lighting unit 1, the external force is not directly transmitted to the circuit substrate 7 but is transmitted to the circuit substrate 7 via the first spring portion 17 and the second spring portion 19 of each bus bar 5.

The external force is not directly transmitted to the circuit substrate 7, which prevents the malfunction of the circuit substrate 7 when the external force is applied to the lighting unit 1, and prevents a deterioration of contact reliability at an electrical connection portion between each bus bar 5 and the circuit substrate 7.

Figure 14:
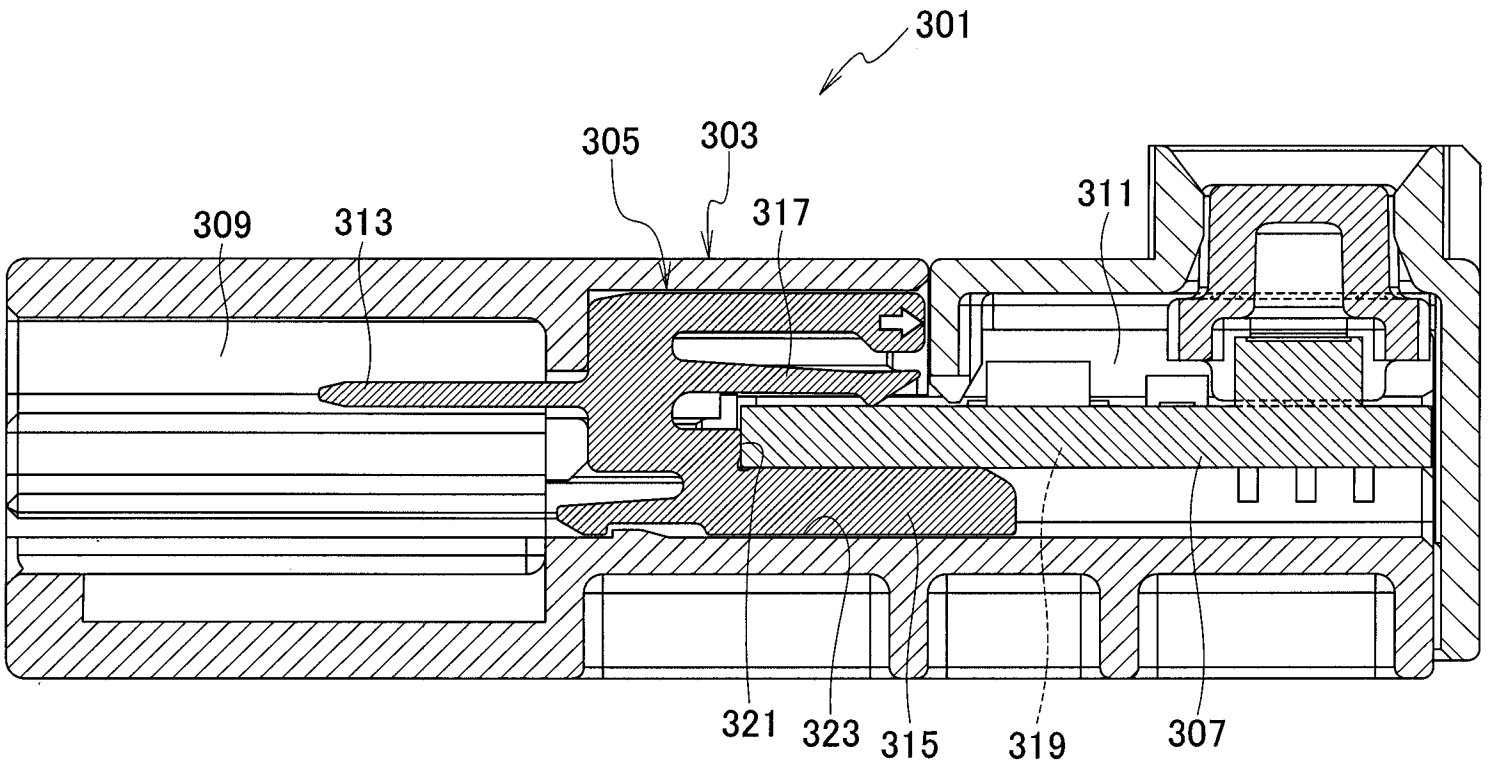
FIG. 14 is a cross-sectional view of a lighting unit according to a comparative example.

A lighting unit 301 according to a comparative example illustrated in FIG. 14 includes a housing 303, a bus bar 305, and a circuit substrate 307. The housing 303 includes a connector fitting chamber 309 to which a mating connector is to be fitted and a component receiving chamber 311.

The bus bar 305 includes a tab terminal part 313, a fixed contact part 315, and a spring contact part 317. The tab terminal part 313 is inserted into and received in the component receiving chamber 311 and protrudes into the connector fitting chamber 309. The circuit substrate 307 is inserted and received in the component receiving chamber 311 and is electrically connected to the bus bar 305.

The housing 303 is provided with a substrate guide groove 319 for positioning the circuit substrate 307 at an insertion completion position. The bus bar 305 is provided with a substrate front abutting surface 321 and a substrate lower abutting surface 323 positioned on the circuit substrate 307 at the insertion completion position.

In the lighting unit 301 according to the comparative example, the circuit substrate 307 is supported by the housing 303 and the bus bar 305 is supported by the circuit substrate 307. Therefore, in the lighting unit 301, it is important to prevent an occurrence of malfunction of the circuit substrate 307 due to deformation of the circuit substrate 307 and the like, even when a load is applied to the circuit substrate 307 due to an external force applied to the lighting unit 307.

In the lighting unit 1 according to the embodiment of the disclosure, as described above, it is possible to prevent malfunction of the circuit substrate 7 when an external force is applied to the lighting unit 1, and to prevent a deterioration of contact reliability at the electrical connection portion between the bus bars 5 and the circuit substrate 7.

In the lighting unit 1, in a state where the cover 37 is installed to the housing 3, the abutting part 39 of the cover 37 prevents an upward displacement of the second abutting part 27 of the housing 3 on which the first abutting part 25 of the first spring part 17 of each bus bar 5 abuts. Thus, the bus bars 5 are doubly locked by the housing 3 and the cover 37, which increases a holding force of the bus bars 5 by the housing 3.

In the lighting unit 1, in a state where the bus bars 5 are installed in the housing 3, the second abutting part 41 of the first spring part 17 of each bus bar 5 abuts on the third abutting part 43 of the housing 3, which prevents each bus bar 5 from coming off from the housing 3. Thus, it is possible to prevent the bus bars 5 from coming off from the housing 3 without separately providing a member to be used for preventing the bus bars 5 from coming off from the housing 3.

In the lighting unit 1, a state where the cover 37 is installed to the housing 3, the abutting part 39 of the cover 37 prevents a rearward displacement of the third abutting part 43 of the housing 3 on which the second abutting part 41 of the first spring part 17 of each bus bar 5 abuts. Thus, the bus bars 5 are doubly locked by the housing 3 and the cover 37, which increases a holding force of the bus bars 5 by the housing 3.

In the lighting unit 1, a state where the bus bars 5 are installed in the housing 3, the bus bars 5 are held by the housing 3 with a biasing force in the height direction. This configuration prevents the tab terminal part 13 of each bus bar 5 installed in the housing 3 from wobbling. This wobble is caused by a rotation about a predetermined axis extending in the lateral direction.

In the lighting unit 1, in a state where the bus bars 5 are installed in the housing 3, the bus bars 5 are positioned to the housing 3 by a lateral biasing part 45 with a lateral biasing force. This configuration prevents the tab terminal part 13 of each bus bar 5 installed in the housing 3 from wobbling. This wobble is caused by a rotation about a predetermined axis extending in the height direction and a rotation about a predetermined axis extending in the front-rear direction (rotation indicated by arrows in FIG. 12).

In the lighting unit 1, since the bus bar contact parts 29 respectively contact the substrate contact parts 31, the circuit substrate 7 is held in a plurality of places separated from each other. Thus, the circuit substrate 7 can be held in a more stable state by using each bus bar 5. This more accurately prevents a positional displacement of the light emitting diode 99 on the circuit substrate 7.

In the lighting unit 1, in a state where the bus bars 5 are installed in the housing 3, the first pair of side surfaces of the square columnar distal end portion 49 of the tab terminal portion 13, which are opposed to each other, is perpendicular to the height direction. Thus, smooth surfaces having low roughness can be brought into contact with the terminal of the mating connector, which enhances the reliability of the electrical connection with the terminal of the mating connector.

In the lighting unit 1, the above-described configuration can protect the circuit substrate 7, secure the reliability of the electrical connection between the circuit substrate 7 and the bus bars 5, and miniaturize the lighting unit as compared with the lighting unit 301 according to the comparative example.

Although the present embodiment has been described above, the present embodiment is not limited thereto, and various modifications can be made within the scope of the gist of the present embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lighting unit comprising:

a housing;

a bus bar including a base part, a first spring part and a second spring part, wherein in a state where the bus bar is installed in the housing, the base part and the first spring part are held by the housing in a first direction, and the bus bar is positioned with respect to the housing in the first direction by a biasing force of the first spring part on the housing in the first direction; and a circuit substrate including a bus bar contact part, wherein in a state where the circuit substrate is installed to the bus bar installed in the housing, the bus bar contact part contacts a substrate contact part provided to the second spring part such that the circuit substrate is held by the base part and the second spring part in the first direction by a biasing force of the second spring part on the circuit substrate in the first direction, and the circuit substrate is positioned with respect to the bus bar in the first direction.

2. The lighting unit according to claim 1, wherein an abutting part is provided to the first spring part of the bus bar, and in the state where the bus bar is installed in the housing, the abutting part of the first spring part abuts on an abutting part of the housing such that the bus bar is prevented from coming off from the housing.

3. The lighting unit according to claim 2 further comprising a cover to be integrally installed to the housing, including an abutting part, wherein in a state where the cover is installed to the housing in which the bus bar is installed, the abutting part of the cover prevents the abutting part of the housing from being displaced in a direction where the bus bar comes off from the housing.

4. The lighting unit according to claim 1, wherein the housing includes a lateral biasing part, in the state where the bus bar is installed in the housing, the lateral biasing part positions the bus bar with respect to the housing with a biasing force in a second direction, and the second direction is a thickness direction of each of the base part, the first spring part and the second spring part formed in a flat plate shape.

5. The lighting unit according to claim 1, wherein the housing includes a connector receiving chamber to which a mating connector is to be fitted, the bus bar includes a tab terminal part, a surface roughness of a first pair of side surfaces facing each other in a square columnar distal end portion of the tab terminal part, is smoother than a surface roughness of a second pair of side surfaces facing each other in the distal end portion of the tab terminal part, and in a state where the bus bar is installed in the housing, the first pair of side surfaces is perpendicular to the first direction.

6. A lighting unit comprising:

a housing;

a plurality of bus bars each including a base part, a first spring part and a second spring part, wherein in a state where the bus bars are installed in the housing, the base part and the first spring part of each bus bar are held by the housing in a first direction, and each bus bar is positioned with respect to the housing in the first direction by a biasing force of the first spring part on the housing in the first direction; and a circuit substrate including a plurality of bus bar contact parts, wherein in a state where the circuit substrate is installed to the bus bars installed in the housing, each bus bar contact part contacts a substrate contact part provided to the second spring part of each bus bar such that the circuit substrate is held by the base part and the second spring part of each bus bar in the first direction by a biasing force of the second spring part on the circuit substrate in the first direction, and the circuit substrate is positioned with respect to the bus bars in the first direction.

* * * * *